United States Patent [19]

Kuchler

[11] Patent Number: 4,586,632

[45] Date of Patent: May 6, 1986

[54] PAPER DISPENSER

[76] Inventor: Fritz Kuchler, Klatteweg 4-6, A 9010 Klagenfurt, Austria

[21] Appl. No.: 507,785

[22] Filed: Jun. 24, 1983

[30] Foreign Application Priority Data

Jun. 24, 1982 [AT] Austria ..... 2454/82

[51] Int. Cl.[4] ..... B65H 1/04

[52] U.S. Cl. ..... 221/63; 221/199; 221/311; 206/449; 271/19; 271/145; 53/DIG. 1

[58] Field of Search ..... 221/33, 61, 63, 311, 221/199, 41; 271/19, 145; 206/449; 211/50; 312/50; 53/DIG. 1

[56] References Cited

U.S. PATENT DOCUMENTS

| | | | |
|---|---|---|---|
| Re. 19,358 | 10/1934 | van Berkel | 53/DIG. 1 |
| 648,603 | 5/1900 | Whitehead | 206/449 |
| 946,728 | 1/1910 | Holz | 221/199 X |
| 985,235 | 2/1911 | Walter | 221/63 |
| 1,391,082 | 9/1921 | Smythe | 221/63 X |
| 2,513,475 | 7/1950 | Greer | 211/50 |
| 2,652,669 | 9/1953 | Holtz | 53/DIG. 1 |
| 3,260,402 | 7/1966 | Lareau et al. | 221/41 X |
| 3,278,180 | 10/1966 | Sleeper et al. | 271/19 |
| 3,878,966 | 4/1975 | Haboush | 221/33 |

*Primary Examiner*—Joseph J. Rolla
*Assistant Examiner*—Kevin P. Shaver
*Attorney, Agent, or Firm*—Karl F. Ross; Herbert Dubno

[57] ABSTRACT

A paper strip dispenser unit is disposed below a food slice receiving surface of food slicing machine. The dispenser is in the form of an elongate container having an upturned open side of which the stack of paper is fanned out to enable individual strips of paper to be withdrawn over the surface to receive sliced food.

1 Claim, 3 Drawing Figures

PAPER DISPENSER

FIELD OF THE INVENTION

My present invention relates to a paper dispenser for extraction of wrapping paper, especially of layering strips for carrying or separating foodstuffs, like sausage slices, cheese slices as well as confectionary, which has a paper container with an extraction opening upon a food slicer.

BACKGROUND OF THE INVENTION

In delicatessen or bakery stores or the like it may be necessary to separate single slices in such a way, that they do not stick to each other or can be separated from each other again without difficulty. At present, layering paper strips are used for this purpose and the paper strips are drawn from a stack.

In the case of automatic sausage cutting machines having a delivery system it is useful to insert a paper strip in each case between the overlapping deposited rows of sausage slices, which paper strip is a little longer than the deposited row. In this way the seller can prepare strips with a row of sausage slices which for instance weighs 100 grams. The customer, for instance, can choose as the cold cuts to be purchased strips of three kinds of sausages. At home, the overlapping sausage slices on the strip can be placed on a tray and served decoratively or the paper can be removed from the strips without disturbing their pattern. In this way an individual cold cut platter can be arranged and served. Layering strips can also be put between single slices in each case.

The inserting of strips has hitherto required considerable time and effort, because the separating of the papers from the pile causes difficulties.

OBJECT OF THE INVENTION

It is the object of the invention to eliminate these shortcomings.

SUMMARY OF THE INVENTION

This is achieved with a paper dispenser which comprises a container which before the extraction area is angled or bent over preferably by 90°. At the angled or bent over part of the container an oblique surface is continued as a contact area for the front side of the cutting edges of the paper in which an excision is provided.

Due to the curvature, the stack of paper strips is fanned out, and at least initially the strips are braced in the direction of the stretched position of the paper strips, that is against the container bottom. Thus the strips do not fall from the paper dispenser but can simultaneously, maybe through pressure against the initial stress by means of the index finger within the excision and by pulling off between thumb and index finger, be removed separately and without difficulty.

The paper must have certain measurements in order to ensure perfect operation. Consequently provision is made that the container has in the extraction area a zone elevated through 90°, a back wall, side walls as well as the oblique surface in continuation of the raised bottom and that the paper is of a length equal to the length of the entire bottom including the raised parts as well as of the width, which corresponds to the width of the bottom. A cover is not necessary for the container, since the paper strips because of the curvature and the already mentioned initial stress do not fall out of the dispenser.

For the purpose of "locking" the paper stack in the container, at the extraction end of the oblique surface lateral stops like lugs or pegs are provided. The pegs are perpendicular to the oblique surface. The uppermost or covering sheets of the stack support themselves on the lateral lugs or studs and thereby prevent an unintentional displacement of the paper strips in the paper dispenser.

The dimensions of the paper dispenser can be adjusted in such a way that the container, under a working surface or under a mechanism, may be inserted and the angled or bent over part can project in or above the working surface or above the mechanism.

Furthermore, it is advantageous to insert the container in the reception tray of a cutting machine (sausage slicing machine) so the angled or bent over part of the container extends beyond the reception tray. In both cases, the paper supply is located under the working surface, table or platform so that only the extraction end projects above the same. In this manner a layering strip is always handy, without the paper stack being troublesome. Especially during the operation of an automatic cutting procedure of the cutting machine a paper dispenser according to the present invention which is incorporated into the reception tray is advantageous.

BRIEF DESCRIPTION OF THE DRAWING

An embodiment of the present invention is shown in the drawing, in which.

SPECIFIC DESCRIPTION

Figure 1:
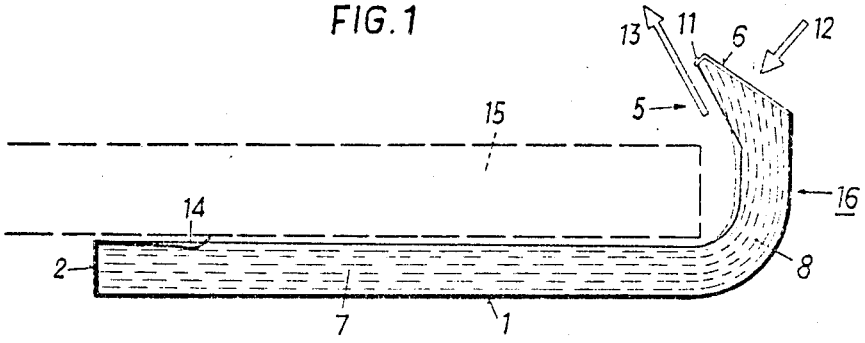
FIG. 1 is a cross section through a paper dispenser according to the present invention.
Figure 2:
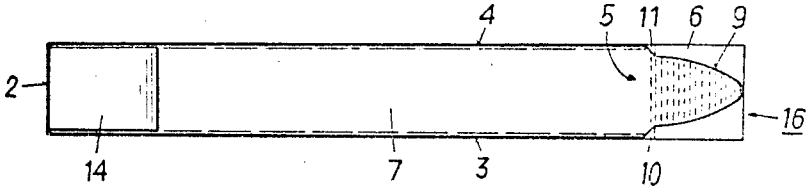
FIG. 2 is a top view thereof.

A paper dispenser according to FIGS. 1 and 2 comprises a container with a bottom 1, back wall 2 and side walls 3, 4. In the extraction area 5 an inwardly oblique surface 6 is continuous with the raised bottom and overlies the latter 1 and the raised side walls 3, 4.

In FIGS. 1 and 2 the paper stack of the paper dispenser is shown in broken lines.

The length of the paper strips must correspond in accordance with the invention to the length of the container bottom including the angled part in the extraction area.

Because of the curvature 8 of the container or container bottom the paper stack in the extraction area 5 is fanned open, as is shown. The oblique surface has an excision or cutout 9 as well as stops like downwardly projecting lugs 10, 11 flanking the cutout, on which at least the topmost sheet of the stack abuts with its front edge. The stops can be studs.

With the index finger it is possible to push out of the container in the direction of the arrow 12 the fanned open part of the paper stack and with the thumb the cover sheet may be pulled out in direction of arrow 13. The thumb and index finger finally grasp the pulled off strip and pull it entirely from the paper dispenser. A leaf spring 14 bears on the end of the paper stack 7.

FIG. 1 further shows how a paper dispenser may be arranged in the manner of a drawer below the work plate 15 (shown in broken lines). To refill the same, the drawer is pulled out.

Figure 3:
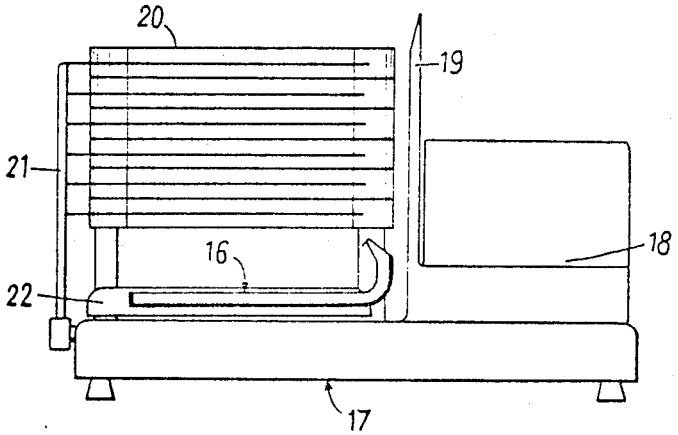
FIG. 3 shows the paper dispenser in side view built into the slicing machine.

FIG. 3 shows the arrangement of the paper dispenser 16 in accordance with the present invention in a cold meat slicing machine 17, which comprises a cutting carriage 18, a circular cutter 19, a conveyor 20 having a striker 21 and a reception tray 22. In the reception tray 22 the paper dispenser 16 is inserted sideways. For this holding brackets are installed under the reception surface of the reception tray 22. The sales person standing in front of the machine 17 can draw with the index finger and thumb of the left hand the required strip if the paper dispenser is appropriately installed immediately at the point of tray 22 at which a row of overlapping sausage slices is deposited by the delivery mechanism of the machine.

I claim:

1. A paper dispenser for wrapper paper, especially layering strips for foodstuff slices, in the form of a paper-strip dispenser unit disposed below a working surface to facilitates feeding individual strips of paper onto said surface in succession to receive respective multiplicities of overlapping slices, said dispenser unit comprising:

an elongate container receiving a stack of said paper strips and disposed below said surface, said container having a bottom wall extending horizontally below said surface and formed with an upwardly bent portion bent arcuately upwardly at an edge through an angle of substantially 90° thereof to extend above said surface, whereby said stack in the region of the upwardly bent portion of said bottom wall has a fanned out edge disposed above said surface, and an upwardly and inwardly inclined wall oblique to said portion of said bottom wall along which said edge of said stack is fanned out, said oblique wall extending from an upper end of said portion of said bottom wall toward the interior of said container, said oblique wall being formed with a finger-receiving cutout enabling individual strips of paper to be withdrawn from said stack directly over said surface, said container also comprising a back wall opposite said portion and a pair of side walls, said stack being dimensioned to extend the full length of said container between said oblique wall and said back wall and having a width substantially corresponding to the spacing between said side walls, said back wall being provided with a leaf spring pressing downwardly upon said stack, said oblique wall being provided adjacent said cutout with a pair of downwardly extending lugs engageable at least with an uppermost sheet of said stack for retaining same until said uppermost sheet is withdrawn from said stack.

* * * * *